US006077334A

United States Patent [19]

Joannou

[11] Patent Number: 6,077,334

[45] Date of Patent: Jun. 20, 2000

[54] EXTERNALLY IONIZING AIR FILTER

[76] Inventor: Constantinos J. Joannou, 62 Lortie Street, Aylmer, Quebec, Canada, J9H 4G5

[21] Appl. No.: 08/876,369

[22] Filed: Jun. 16, 1997

Related U.S. Application Data

[63] Continuation-in-part of application No. PCT/CA96/00730, Nov. 8, 1996, which is a continuation-in-part of application No. 08/373,072, Jan. 17, 1995, Pat. No. 5,573,577.

[51] Int. Cl.[7] ..... B03C 3/155

[52] U.S. Cl. ..... 96/66; 96/97

[58] Field of Search ..... 96/97, 55, 96, 96/59, 66

[56] References Cited

U.S. PATENT DOCUMENTS

| | | | |
|---|---|---|---|
| 945,917 | 1/1910 | Cottrell | 96/97 X |
| 2,593,869 | 4/1952 | Fruth | 96/96 X |
| 3,706,182 | 12/1972 | Sargent | 96/55 |
| 4,041,768 | 8/1977 | Gibert et al. | 96/97 X |
| 4,098,591 | 7/1978 | Van Diepenbroek et al. | 95/57 |
| 4,244,710 | 1/1981 | Burger | 96/97 X |
| 4,549,887 | 10/1985 | Joannou | 96/58 |
| 4,828,586 | 5/1989 | Joannou | 96/66 |
| 5,055,115 | 10/1991 | Yikai et al. | 96/97 X |
| 5,407,469 | 4/1995 | Sun | 96/97 X |
| 5,518,531 | 5/1996 | Joannu | 96/55 |
| 5,573,577 | 11/1996 | Joannou | 96/96 X |

FOREIGN PATENT DOCUMENTS

| | | | |
|---|---|---|---|
| 1294226 | 1/1992 | Canada . | |
| 5-154408 | 6/1993 | Japan | 96/97 |
| 1667929 | 8/1991 | U.S.S.R. | 96/97 |
| 85/02792 | 7/1985 | WIPO . | |

OTHER PUBLICATIONS

IBM Technical Disclosure Bulletin, XP–002056412, Ii et al, vol. 17, No. 9, Feb., 1975.

*Primary Examiner*—Richard L. Chiesa

[57] ABSTRACT

An air filter assembly includes an ion source positioned adjacent to the front face of an air filter to inject ions into the arriving air flow. The ions penetrate upstream sufficiently far to have ionized the air and charge particles before their arrival at the filter trapping medium. The ion source is preferably sufficiently thin as to allow the filter with the ion source mounted thereon to be inserted into a filter slot in a duct of an air handling unit.

27 Claims, 9 Drawing Sheets

EXTERNALLY IONIZING AIR FILTER

This is a Continuation-in-Part application of PCT/CA96/0,0730, filed Nov. 8, 1996 which is in turn a Continuation-in-Part of U.S. Ser. No. 08/373,072 filed Jan. 17, 1995 and issued as U.S. Pat. No. 5,573,577 on Nov. 12, 1996.

FIELD OF THE INVENTION

This invention relates to air filters. In particular it relates to air filters whose performance is enhanced by ionizing the air carrying dust particles before such particles enter a trapping filter pad.

BACKGROUND TO THE INVENTION

Ionization has long been used to promote the removal of particulate matter from air. In an early U.S. Pat. No. 945,917 to Cottrell (1910) particulate-laden air is ionized and the charged particles thereby formed were collected on an electrically grounded surface.

Precipitator-type air filters of the type depicted in U.S. Pat. No. 2,593,869 to Fruth (1952) first ionize the particulate-carrying air, and then pass the air flow between oppositely charged parallel plates to which the particulates adhere. Such precipitating air cleaners are highly efficient when the plates are initially clean. However, performance drops off as the plates become covered with collected dust. Hence regular cleaning is required to maintain efficiency. This cleaning operation for precipitator-type air cleaners is awkward and costly to effect.

It is known to also trap airborne particles in disposable filter media such as granulated charcoal and fibrous matrices of glass wool and the like. The trapping capacity of such filter media can be enhanced by ionizing the air, and dust therein, before it enters the filter medium. U.S. Pat. Nos. 3,706,182 to Sargent (1972) and 4,244,710 to Burger (1981) both depict such an arrangement.

In both of these references ions are introduced into the air flow stream by ion emitters positioned at an upstream location in the air flow, at a spaced distance from the filter medium that is intended to remove ionized particles. A prior invention that also relies on the upstream release of ions into air ducts has been made by the present inventor, as represented in U.S. Pat. No. 5,518,531.

Apart from whether ionization is present, it is known that the trapping efficiency of a trapping medium of dielectric material such as glass can be enhanced by polarizing the medium under an electrical potential field having a high field gradient.

Two examples of prior art patents based on the polarization principle are U.S. Pat. Nos. 4,549,887 and No. 4,828,586, the contents of which are adopted herein by reference. The first patent describes a pair of outer hinged screens for enclosing a pair of glass fibre pads in a kind of a "sandwich" with a central grid located therebetween. The central grid, made of coarse wire mesh that is on the order of 0.5 millimeters in diameter, is charged to around 7000 volts and the outer screens are grounded. The spacing between the charged screens is between two and five centimeters, producing an electric field gradient. This field gradient polarizes the non-conducting glass fibres rendering them more active in trapping dust particles, and more effective than non-polarized pads. This configuration does not generate ions to any significant extent.

An advantage of this polarized type of filter is that the accumulated dust is readily removed by exchanging the dust-laden fibre pads for fresh pads. However, polarized filter air cleaners are not as efficient as precipitator-type ionizing air cleaners. Considerable advantages can be achieved by combining features of both systems.

U.S. Pat. No. 5,403,383 to Jaisinghani depicts an "Ionizing Field Electrically Enhanced Filter" wherein air passes through ionizing wires before reaching a separately-spaced pad of dielectric material that has a grounded electrode on its downstream side. To effect increased ionization Jaisinghani provides a further charged "control grid" positioned upstream from the ionizing wires in the air flow. This control grid helps provide field gradients that will create the desired degree of ionization at the ionizing wires. However, this upstream control grid acts as an obstructing screen which limits the upstream diffusion of ions into the arriving air flow. Filter replacement does not disturb the ionizing wires which are separated from the filters and are permanently connected to the external supporting body of the overall system.

The present inventor has also obtained a U.S. Pat. No. 5,573,577 issuing after the priority date herein for an improved grid for use in a polarizing filter that is made of a fibrous conducting filament with many protruding filament ends. These pointed ends create ionization in the air passing through the polarized trapping medium, enhancing filter efficiency.

A major concern in respect of all ionization-based air cleaners is to minimize the production of ozone. Ozone is offensive to some and can be injurious above certain levels. Any system that relies on ionization should also minimize the production of ozone.

The production of ozone is associated with power consumption i.e. the providing of a current flow under an applied voltage potential. The design and fabrication of high voltage supplies that deliver significant current is complex and costly. Great advantages arise when high voltage supplies are operated at low power levels. By avoiding the production of corona and associated ozone, the advantages using a low power, high voltage supply become available.

Canadian Patent No. 1,294,226 discloses a low cost, low power, high voltage power supply that can be conveniently attached to a disposable air filter.

It is an object of this invention to provide for the incorporation of ionization into an air filtration system in a manner than is of minimal cost while being convenient to employ.

It is a further objective of this invention to provide for an ionizer which can be part of a filter and, if the filter is electronic with its own power supply, the ionizer can be connected to the filter's power supply. In this way, only one installation is required for one filter-ionizer combination.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

A principal feature of the present invention is that ions are introduced into an air stream to be filtered by providing an ion source that is located adjacent to the trapping medium through which the air stream will pass. Preferably, the ion source is actually carried and supported by the filter medium. The ion source in all cases is positioned so as to emit ions that are directed upstream, into the oncoming air flow, so that a zone of ionized air is formed within the air stream in advance of the trapping medium and the ion source. The objective is to produce a cloud of ions that will expand into the air flow in the upstream region, preferably without interference from ion-interfering obstacles, so that by the time the airflow arrives at the trapping medium, substantially all particulate matter carried therein will have acquired a charge from the cloud of ions.

By positioning the ion source adjacent to the trapping medium and orienting the ion source to direct ions into the upstream region through which the air flow arrives a compact filtering assembly of improved efficiency can be created. The efficiency of the assembly can be further enhanced by providing for the trapping medium to be a polarizable substance and arranging for it to be polarized by an applied electrical potential field.

In a preferred variant, this invention provides for a thin ionizer which can be attached to the front of a filter to ionize the air entering the filter and yet is thin enough to allow for the filter's insertion into a slot in an air cleaning apparatus. The ionizer preferably comprises one or multiple sharp-ended, ion-forming, charged electrodes each being exposed to a local field gradient about their ion emitting portions that is sufficiently intense so as to create ions in the air, but without creating an undue amount of ozone. The electrode, such as a needle or sharply pointed conducting fibres, is supported by a thin, insulated holder which is attachable to a filter. The ionizing element is connected to a high voltage power supply. The power supply may be part of a power supply of an electronic filter.

A particular phenomenon which supports the operation of this invention is that the ions so formed, whether positive or negative, expand away from their source under the influence of their mutual repulsion. Proximate to the source, an actual "ion wind" can be detected. By utilizing the combination of a properly shaped and positioned electrode, and an applied potential of adequate strength, the field gradient at the ion emitting location(s) on the electrode can be made sufficiently intense so as to create profuse numbers of ions. These ions form as a dense cloud which has an intense propensity to expand. This propensity to expand is sufficiently strong to cause ions emitted from a properly positioned electrode to travel upstream, even against the current of an incoming air flow. As this ion cloud travels upstream it also expands laterally. This helps increase the prospects that most, if not all, of the particulate-laden air arriving at the filter medium will have become ionized.

While an ion source positioned adjacent to a filter medium may, at low air velocities, be capable of ionizing most of the air arriving at the filter medium, as the air flow velocity increases, it may be thought that the extent to which the ion cloud will penetrate into, and expand across, the incoming air stream will be reduced. However, tests have shown that when the ion cloud is being deformed by a high velocity airflow, more ions are produced. This increase in ion production may be arising because of the removal of the "back pressure" that the ion cloud generates in respect of the emission of ions from the ion source. Thus, the ion cloud that forms upstream from the ion source resists truncation with increasing rates of air flow. In all events, when large filter areas are involved, multiple or elongate ion sources may be provided to ensure that ionization exists within most of the air arriving at the filter medium.

Various configurations may be employed to provide an ion source according to the invention. An insulated holder, preferably dome shaped, may be provided with a needle which serves as the ionizing element or ion source mounted thereon. The needle may lie within a recess formed in the outer face of the holder to enable the filter on which the holder is attached to pass through a slot in an air handling system without interference. Or it may be resiliently mounted in an upright position to permit the same result. Equally, a sharp-edged, linear electrode that emits ions readily could be used in place of a needle.

The insulated holder provides insulation between the ionizing element and the adjacent filter which may have a conducting screen or conducting surface positioned on its outer side to serve as a field-gradient-inducing electrode in the case of a polarized filter. The adjacent screen, which serves as a counter electrode, should have a potential that differs sufficiently from that applied to the ion emitting electrode in order to form the requisite field gradient at the ion emitter. Preferably, the screen is grounded.

The dimensions of the insulating holder are selected to provide for a spacing between the ionizing element and the counter electrode that ensures that the potential gradient around the ionizing element is high enough to produce ionization but not so high as to produce corona or arcing. For this purpose, care must be taken not to provide too great a charge collecting surface on the insulated holder. An excessively large non-conducing surface will accumulate charge which will dilute or reduce the intensity of the field gradient around the ionizing element, preventing ions from forming.

As an alternative to having a counter-electrode positioned downstream from the ion emitter on the filter pad, the counter-electrode may be provided by the frame assembly holding the filter media, or by metal ducting carrying the air to the filter assembly. This latter arrangement is normally preferred. However when the ion emitter is used in conjunction with a filter assembly having a grounded outer screen on the upstream side of the sandwich combination of pads and screens, the field gradient at the ion emitting locations on the ion source will necessarily be effected, and the precautions mentioned above should be observed.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1A:
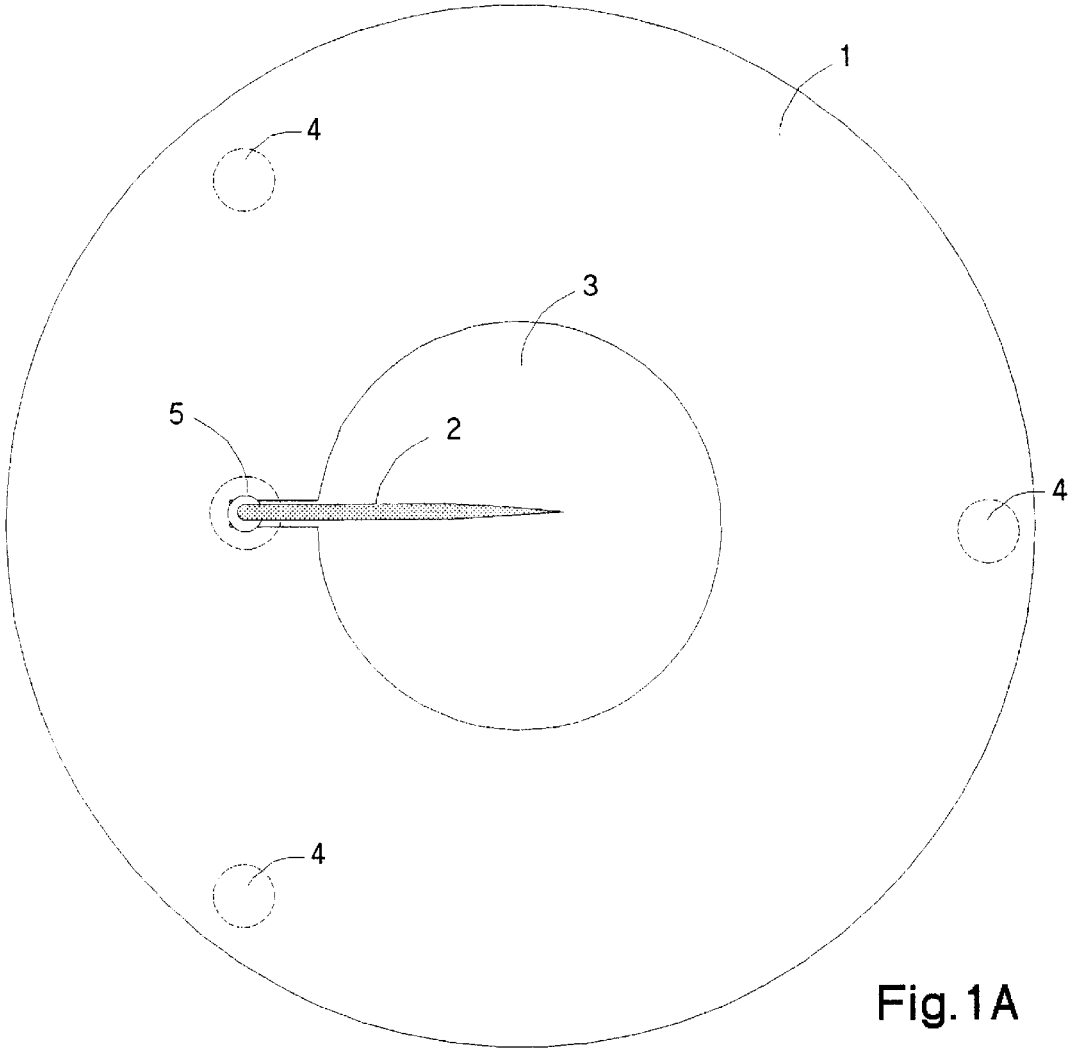
FIGS. 1A and 1B show the insulated holder and ionizing element (a needle) in top view and cross-sectional elevation views respectively.

In FIGS. 1 to 6, insulated holder 1 holds ionizing elements in the form of a needle 2 or fibres 15. The upper part of holder 1 is dome-shaped with a circular recession 3 formed in its outer, outwardly-directed, domed surface. Mounting protrusions 4 are present along the bottom of holder 1 for attachment to a supporting screen 6 or filter pad 18.

A protrusion 5 with a hole in it is provided to allow a bent portion of needle 2 to pass through to the other side of the holder 1. Needle 2 is bent at 90 degrees and the upper part of the needle lies in recess 3.

Figure 2:
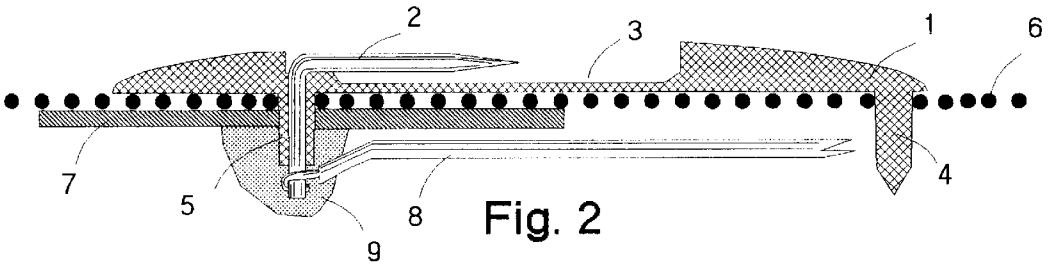
FIG. 2 shows the ionizer in cross-sectional view, installed on the outside grounded screen of an electronic filter.
Figure 3:
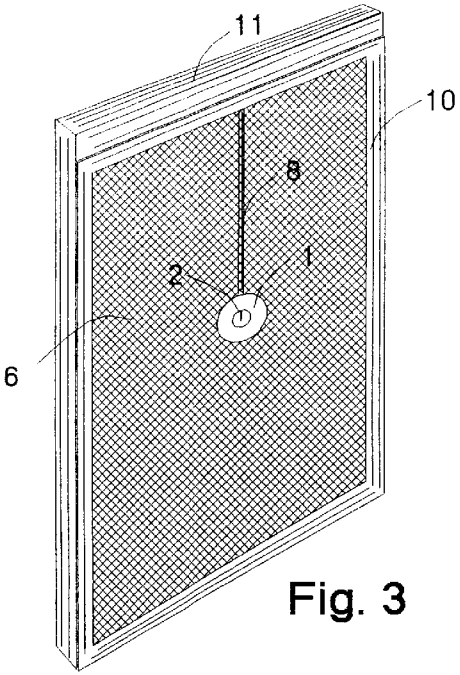
FIG. 3 shows a typical installation of the ionizer on an electronic filter.

FIG. 2 shows the ionizer installed on an outside screen 6, covering a filter pad 10 (shown in FIG. 3). Mounting protrusions 4, 5 pass through the screen 6 to support the holder 1 on the screen 6. A thin, insulated coupling plate 7 with a hole in it fits over protrusion 5 on the side of the screen 6 remote from the needle 2 in order to provide insulation around the junction of needle 2 with wire 8. Insulated wire 8 is attached at one end to needle 2 and at the other end to a common high voltage power supply 11 (shown in FIG. 3). Insulating sealant material 9 like "hot glue" or silicon rubber, etc. preferably insulates the needle-to-wire connection.

FIG. 3 shows the ionizer unit installed on an electronic filter 10 in which the metallic screen 6, on its outer side serves as a counter electrode by being connected to a high voltage power supply 11 included as an integral part of the filter 10. Insulated wire 8 passing behind the screen 6 connects the needle 2 to the power supply 11 to provide the needle 2 with a high potential. The metal screen 6 is preferably grounded. Alternately, the ionizing element 2 may be grounded and the screen 6 may have an elevated potential.

Figure 4A:
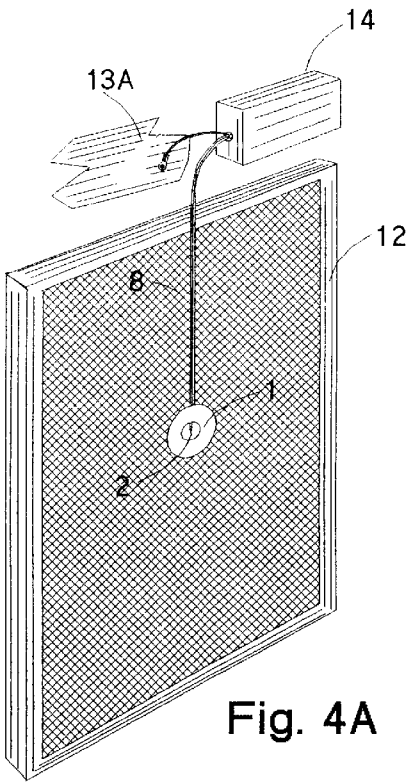
FIG. 4A shows a variation of FIG. 4 without a counter electrode present.
Figure 4:
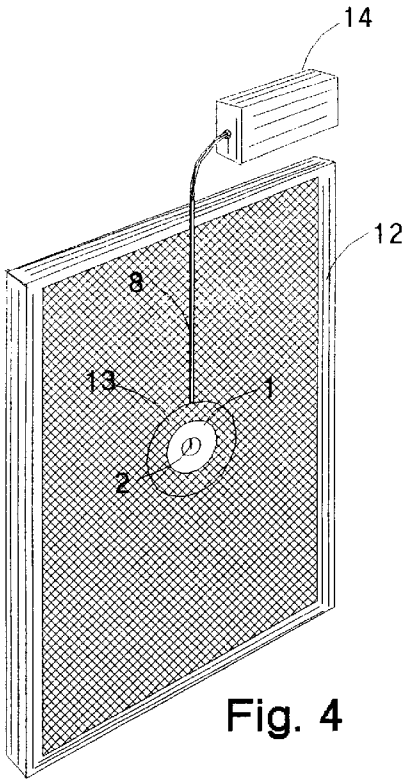
FIG. 4 shows a typical installation of the ionizer on a passive, non-electronic filter with a counter electrode present.
Figure 7:
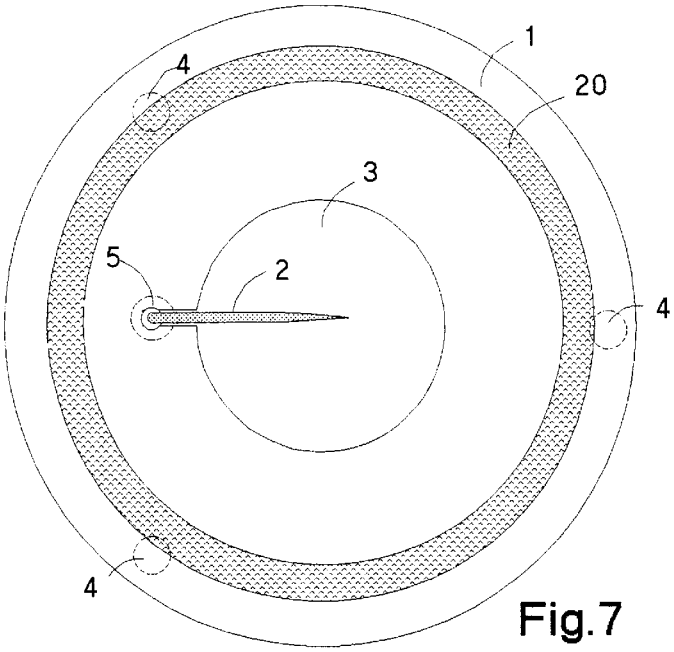
FIG. 7 shows a thin ionizer arrangement where the counter electrode is part of the ionizing element holder.

FIG. 4 shows the ionizer installed on a passive filter 12 which has no screen covering its outside surface and no high voltage power supply of its own. In this case, a circular, conductive counter-electrode 13 may optionally be attached or glued to the non-conducting, passive filter's 12 outer, rear surface and ionizer 1 than attached to the filter pad 18 through the counter electrode 13. Counter electrode 13 is connected to the high voltage terminal of power supply 14 and acts in the same way as the screen 6 of the filter shown in FIG. 3. This electrode 13 may be a screen, a metal ring 20 and it may be part of needle holder 1 (FIG. 7).

As an alternative to providing a dedicated counter electrode component in the form of screen 13, conducting parts of the support for air filter 12 or surrounding ducting 30 (as in FIG. 14) or another electrical ground may serve as the counter electrode. FIG. 4A shows this arrangement where 13A is a ground connection respecting a duct or electrical ground, etc.

The objective in all cases is to create the requisite field gradient for ionization at the ion-forming locations on the ion source 2,15.

Geometrically, it has been found that in an electronic, polarized filter with grounded outer screens 6 and a central charged, grid-electrode sandwiched between two-2 cm thick glass fibre pads and charged to 7000+ volts, the ionizer may be connected to and provided directly with the central electrode's potential. In such case, the holder 1 has been made of polyproplene or similar plastic and may be kept to a diameter of preferably 3–8 cm. The needle 2 was located in a 1 mm recess formed in a holder 1 which is 3 mm thick.

Use of a larger diameter holder 1 with a needle 2 was found to reduce the ion-generating capacity of the system. Use of a separate potential source of +10,000 volts with a 4 cm diameter holder 1 was found to produce copious ions without undue corona or ozone being generated.

The ions generated had sufficient mobility due to their mutual repulsion to travel upstream against an incoming flow of air arriving at a speed of up to 500 feet per minute.

Figure 5:
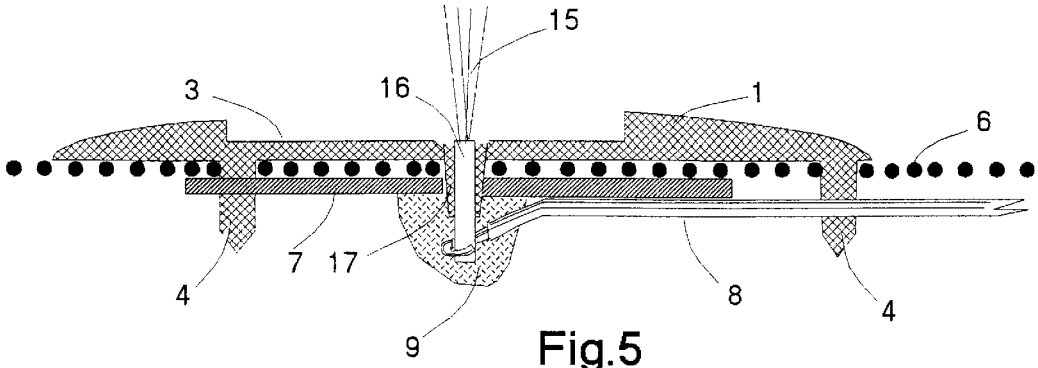
FIG. 5 shows an alternative construction of the ionizer using a bundle of upright conductive fibers instead of a needle.

FIG. 5 shows another alternative structure where the ionizing element is a bundle of elastically resilient, fine, conducting fibres 15 with sharply pointed ends. The fibres 15 can flex and do not interfere with insertion of the filter into a slot 30 (see FIG. 14). A conducting support sleeve 16 holds fibres 15 upright above the holder 1 with the sleeve 16 being within the recess 3. A hollow, downwardly-directed protrusion 17 extending below holder 1 (similar to the pin-carrying protrusion 5) can be used to support the sleeve 16. In this arrangement, however, protrusion 17 is located in the centre of holder 1.

Figure 6:
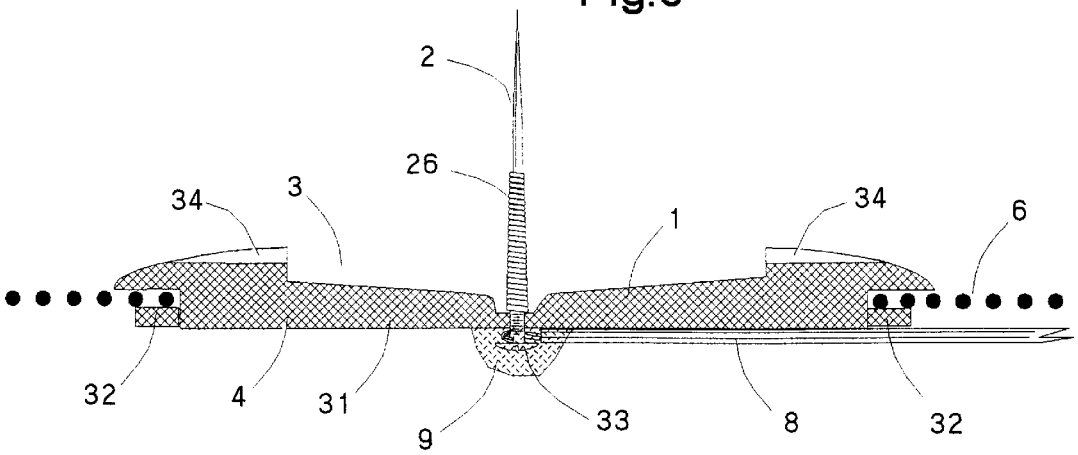
FIG. 6 shows a variant on FIG. 5 wherein an upright needle is supported on a spring.

In FIG. 6 a needle 2 held by a spring 26 replaces the fibres 15 and sleeve 16 as the ionizing element. An enlarged central protrusion 31 and circular locking ring 32 of insulative material fasten the holder 1 to screen 6. Alternately, the holder 1 may be attached to a plate of insulative material which is part of an arm 35 (shown in FIG. 14) for positioning the ion source in front of a filter pad 18. Protrusion 31 acts as an insulator to prevent the risk of arcing between the wire 8 and screen 6 and thus insulator 7 (FIGS. 2 and 5) is not needed. Screw 33 connects wire 8 to spring 26. Spring 26 is removably attached to screw 33 by unthreading from above for safety when handling the unit. Also, holder 1 has indentations 34 (preferably four) on the periphery to enable the needle 2 to recline into one of these indentations when the filter/ionizer combination is inserted into a slot 41 in a duct 30 without damaging the spring 26 or the needle 2.

In FIG. 7 a counter electrode in the shape of a conducting ring 20 is included as part of the ionizing element holder 1 itself.

Figure 1B:
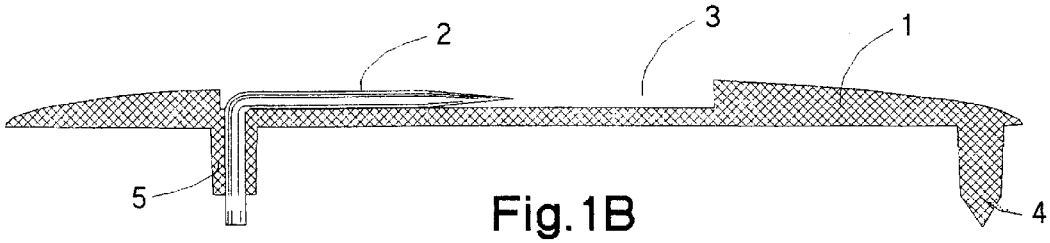
Figure 8:
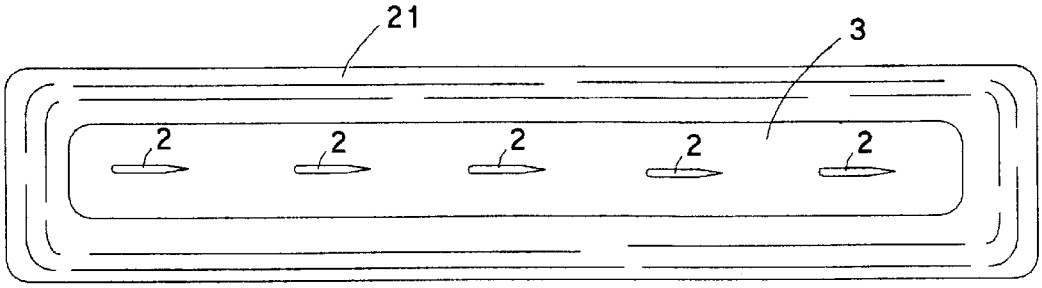
FIG. 8 shows an elongated ionizer using many ionizing elements.

In FIG. 8 an elongated ionizing element holder 21 similar in function to the one shown in FIGS. 1A and 1B supports a plurality of ionizing elements 2 (needles for instance) all electrically connected together. This arrangement may be used in conjunction with long filters so that ionization can cover the entire area of the filter medium.

Figure 9A:
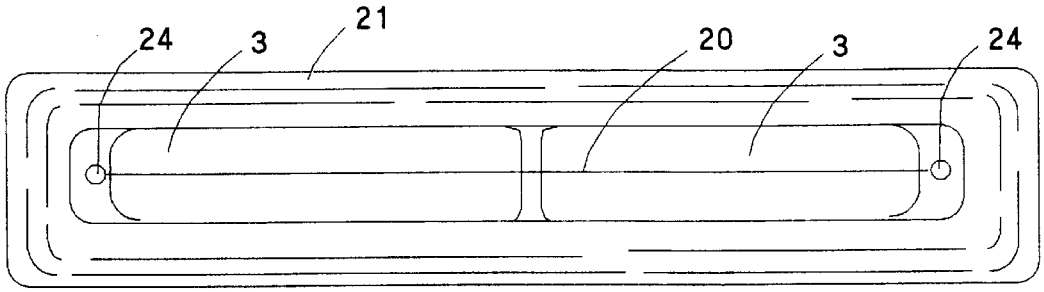
FIGS. 9A and 9B show the same holder as FIG. 8, but with a single long ionizing element.
Figure 9B:
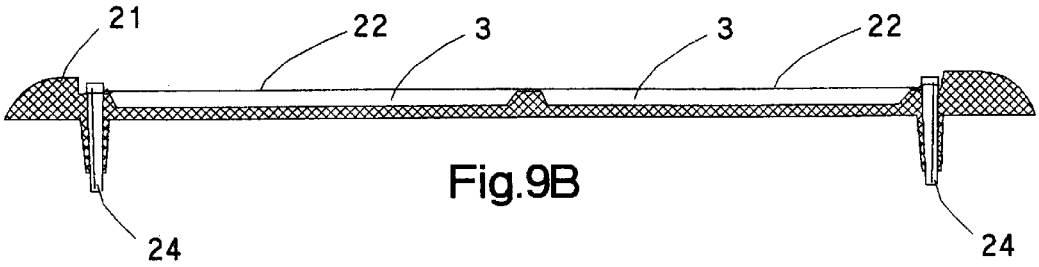

In FIGS. 9A and 9B a thin conductor 22 such as a wire (of the order of 0.002" dia.) functions as an ionizing element. Conducting posts 24 support wire 22. Conductor 22 may also be made of a bundle of fibres with protruding, sharp fiber ends, such as a string which has been rendered conducting.

Figure 10:
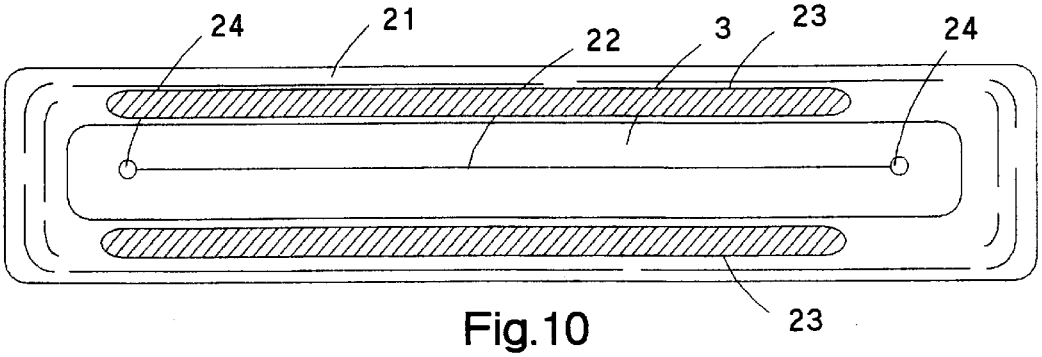
FIG. 10 shows the same ionizer as FIG. 8, but with counter electrodes included as part of the ionizing element holder.

FIG. 10 shows a similar arrangement to that of FIG. 9 but includes a counter-electrode 23 made as part of ionizer holder 21.

In the ionizers described herewith, recess 3 functions to protect ionizing elements 2, 22 from mechanical damage. Therefore, if there is no risk of mechanical damage to the ionizer, recess 3 may be omitted.

Figure 11A:
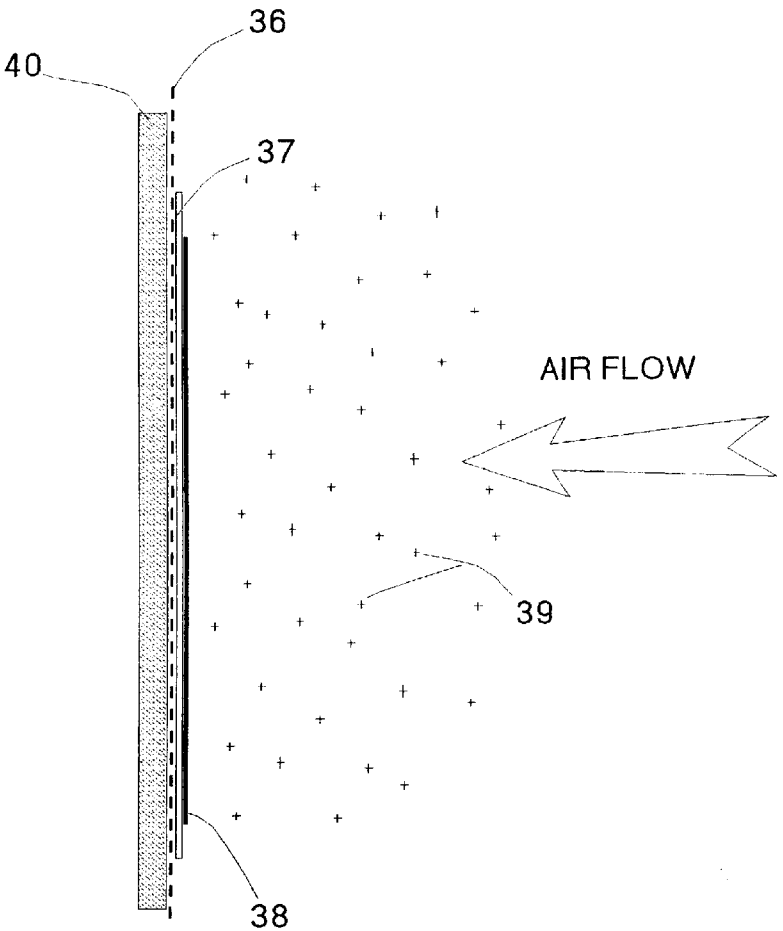
FIG. 11A is an edge view of FIG. 11.
Figure 11:
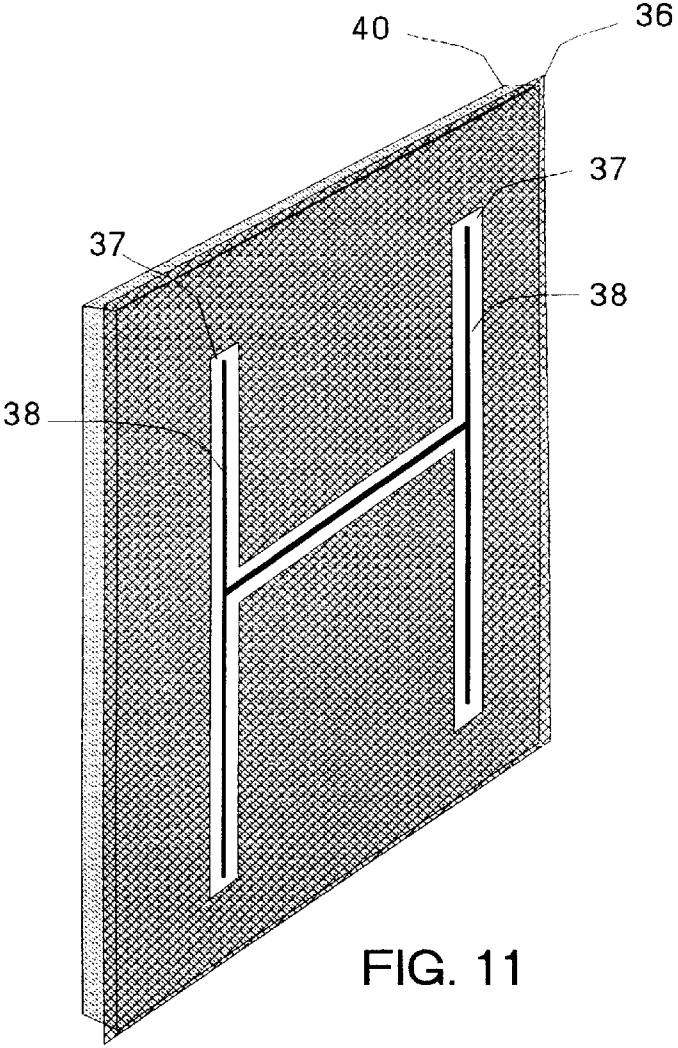
FIG. 11 is a perspective view of a cartridge filter with an exterior ionizing element fixed over an exterior screen by being mounted on insulating tape.

Another variant of the invention is shown in FIGS. 11 and 11A. In these Figures a thin insulating strip of plastic such as polyester 37, is applied over and fastened to an outer, upstream-facing screen 36 of a cartridge filter assembly, in this case in the shape of the letter "H". On top of strip 37 and along its middle line, a fibrous conducting string 38 with ionizing filaments ends (or a thin wire) is attached. A high voltage power supply (not shown in FIGS. 11–13A) is connected between string 38 and grounded screen 36. String 38 is thereby charged to a voltage of between 5 KV and 18 KV. A high resistance value limiting resistor (not shown) in the high voltage source ensures that no danger of injurious electric shock can arise from contacting the charged string 38.

Operation of this arrangement is as follows: The conducting string 38 ionizes the air in the vicinity of the string by emitting charges 39 via its fine fibre ends. These charges ionize (charge) the dust particles in the space in front of the filter. The dust particles are then drawn into the air permeable filter by the air flow and are collected by the filter pad 40. The filter's efficiency improves by this arrangement because charged particles of dust are more readily captured by a filter pad 40.

Figure 12A:
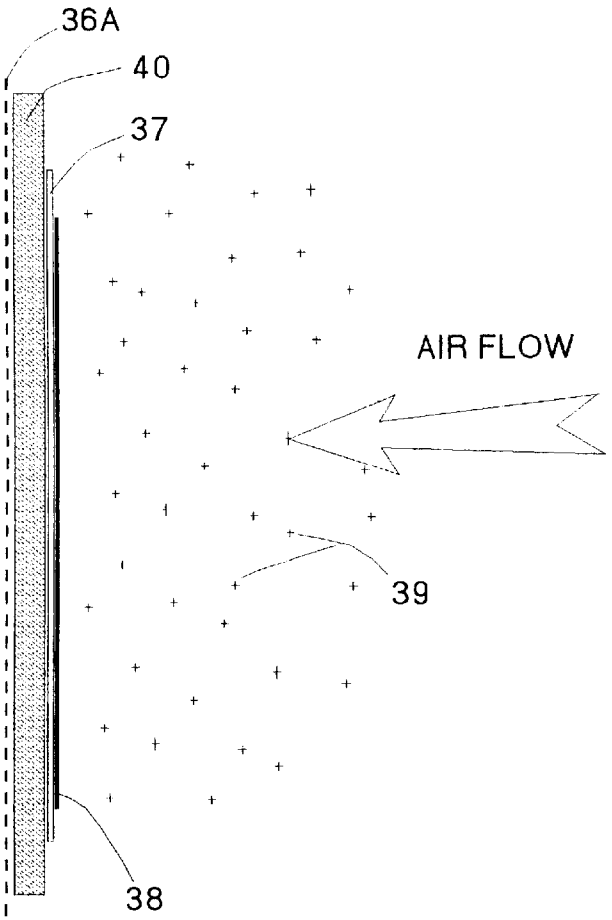
FIG. 12A is a cross-sectional side view of FIG. 12.
Figure 12:
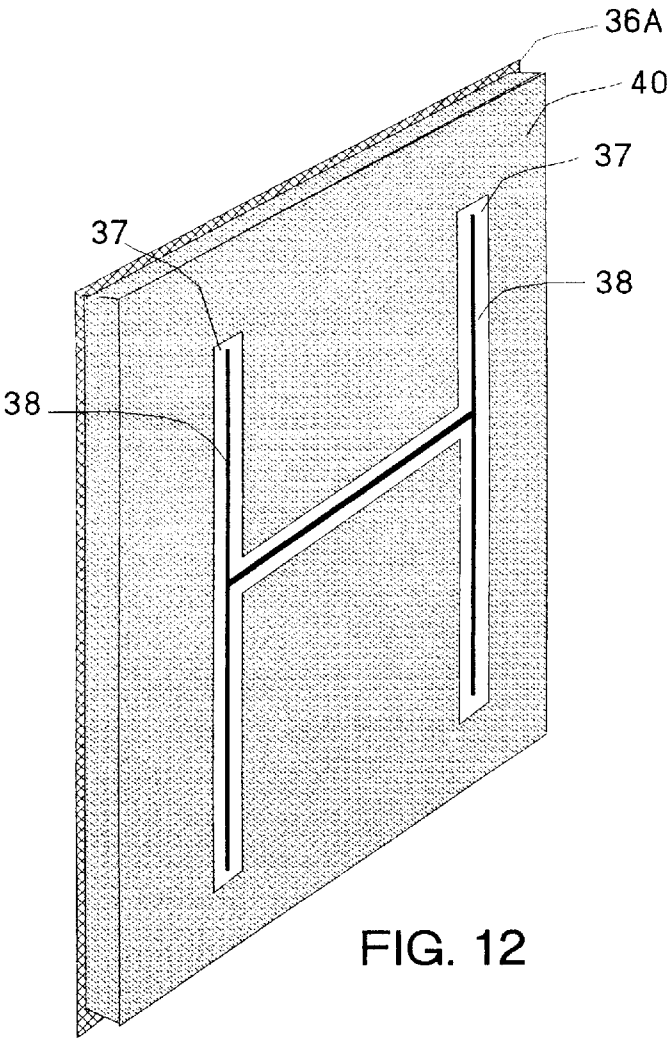
FIG. 12 is a perspective view of a variant of FIG. 11 in which the ionizer is placed in front of a fibrous pad with the counter electrode being behind the pad.

FIGS. 12 and 12A show another arrangement of FIGS. 11 and 11A. In this case, insulating strips 37 and string 38 are placed on top of fibrous pad 40. Behind pad 40 is screen 36 which acts as a counter electrode. In this arrangement, an electrostatic field is created between strings 38 and screen 36 which polarizes fibrous pad 40 as well as forming ions. In this way, the filter's efficiency is increased because of the additional polarization of the filter pad. The polarized media 40 attracts dust particles more readily especially when they are charged by the ions 39 emitted by the ionizer 38.

Figure 13A:
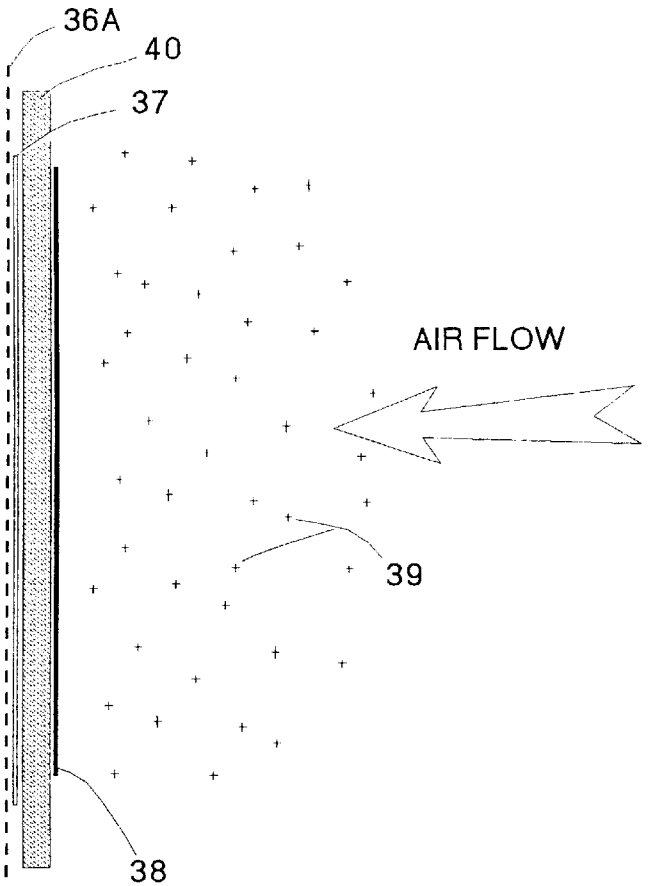
FIG. 13A is a cross-sectional side view of FIG. 13.
Figure 13:
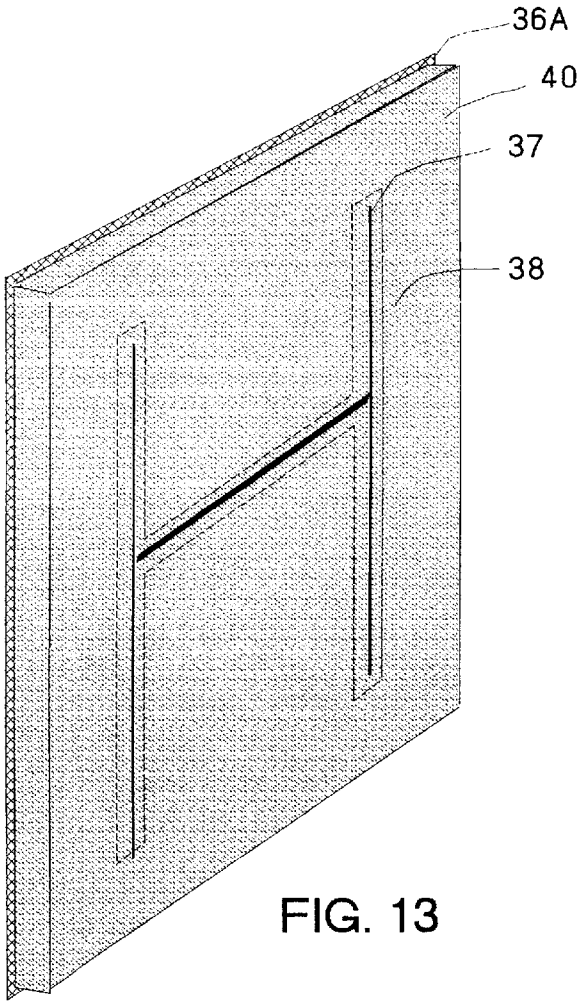
FIG. 13 shows a similar arrangement of thin ionizer as that of FIG. 12 but with the insulating strips moved from directly behind the ionizer element to being positioned between the fibrous pad and the counter electrode.

Yet another similar arrangement is shown in FIGS. 13 and 13A. Here, insulating strips 37 are placed behind pad 40 and in front of screen/counter-electrode 36 to suppress arcing through the pad 40. This arrangement provides for better polarization of the fibrous pad 40 because the pad is in more direct contact with the ionizing strings.

Figure 14:
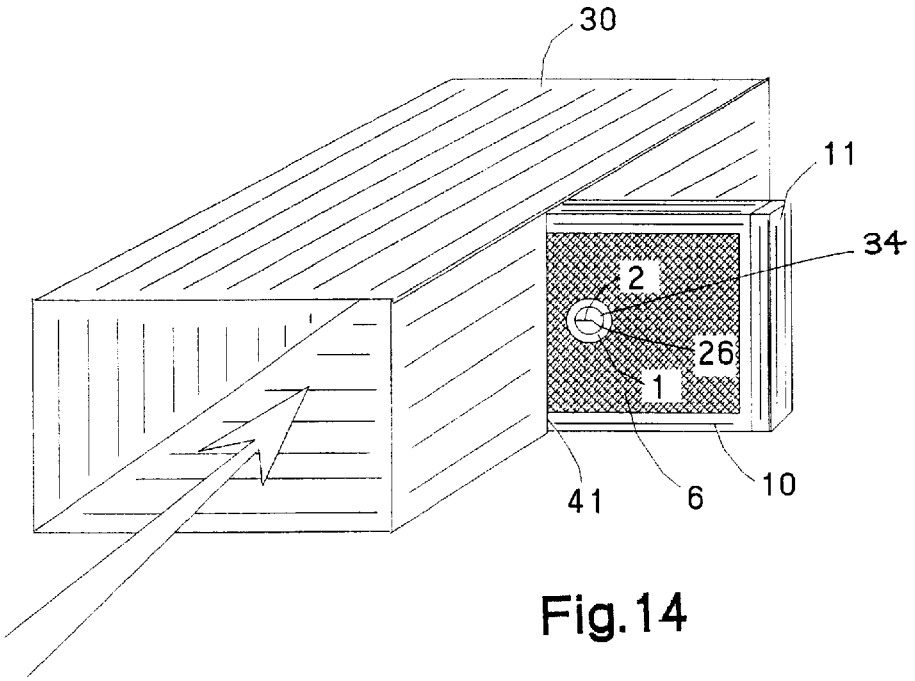
FIG. 14 shows pictorially the filter assembly of FIG. 3 being passed through a thin slot in the side of air ducting.

By providing an ionizer which is thin and mounted on the face of a filter unit 10, the combined unit may be easily installed through a slot 41 in an air duct 30 as shown in FIG. 14. When the filter 10 carries an attached high voltage supply 11, a combined unit is created which is low cost, easy to install and maintain, and is highly efficient at cleaning air or other gas flows.

Figure 14A:
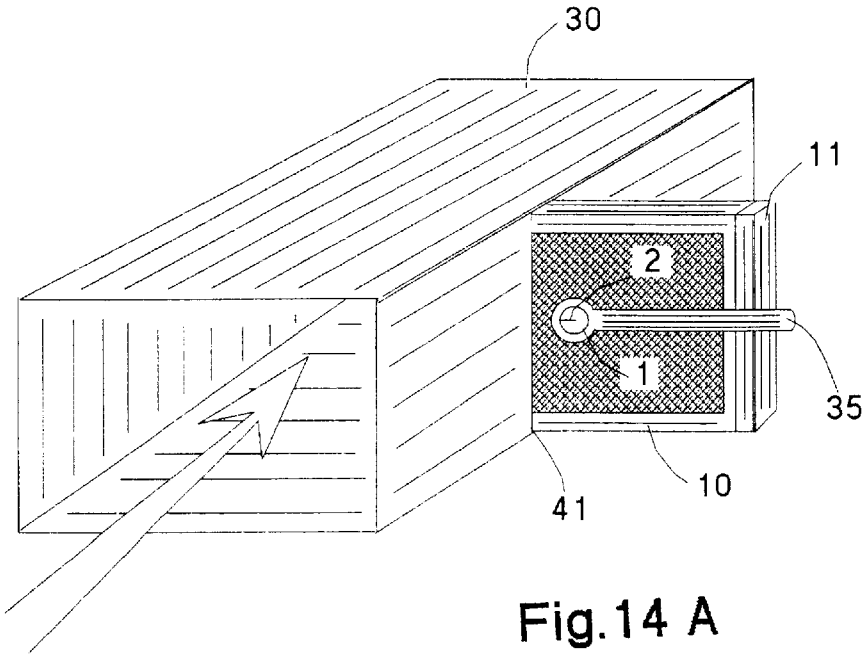
FIG. 14A shows an alternate depiction to FIG. 14 wherein the ionizing element is carried separately from the filter on an insulated arm for positioning in front of, and adjacent, the filter within the ducting.

As an alternative to attaching the ion emitter to a filter 10, as shown in FIG. 14, the ionizing element holder 1 may be carried by an arm 33 of insulative material and thin cross-section as to position the ion source 2 adjacent the filter 10 on its upstream side as shown in FIG. 14A. While it is convenient for a filter to carry the ion source 2, it is sufficient for the ion source 2 to be held separately adjacent the filter.

Tests have been effected comparing a filter without the ionizer and the same filter with the ionizer. The results of these tests are shown in the graph of FIG. 15.

Figure 15:
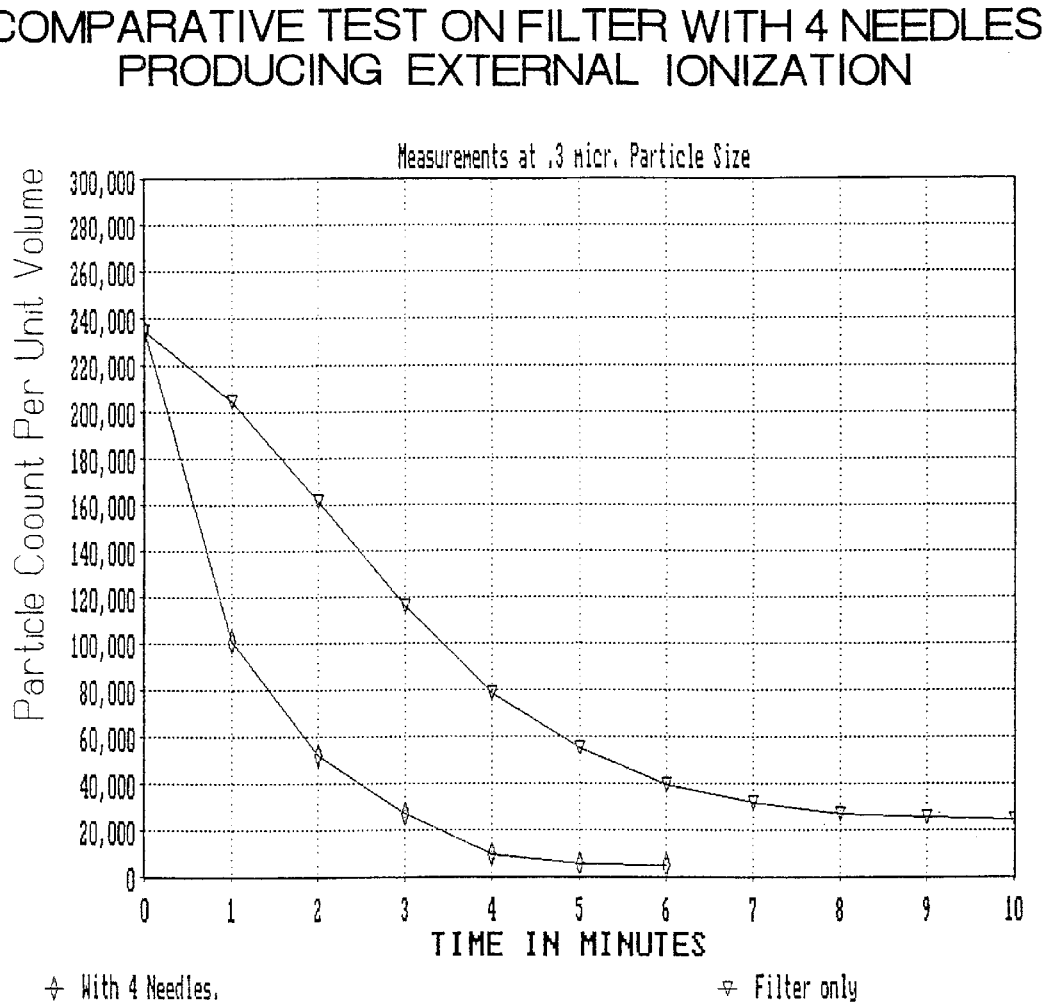
FIG. 15 is a graph showing the improved performance used by having an ionizing source according to the invention operating on the upstream side of a fiber pad.

In FIG. 15 the upper curve represents performance results for a polarized filter without external ionization. Results are presented in terms of removal of smoke particles over time, in a closed room, measured for 0.3 micron particle size. The lower curve provides results for the same filter after addition of four ionizing needles positioned on its external, upstream surface. The rate of decrease of particle counts is clearly higher with external ionization present. The results represent a major improvement in air filtration efficiency.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

What is claimed is:

1. A cartridge electronic air filtration assembly for positioning in a moving air stream constituting an airflow which contains fine particles to be trapped comprising:

(a) a frame for supporting a trapping medium;

(b) an air-permeable trapping medium mounted within the frame for trapping particles, said trapping medium having an airflow receiving face surface to receive air from an oncoming air stream for passage through said trapping medium;

(c) an ion source; and (d) electrical coupling means for connection of the ion source to a power supply that delivers an ionizing voltage, characterized in that the ion source is carried by the air filtration assembly, positioned adjacent to the outer, airflow receiving face surface of the trapping medium, said ion source being directed so as to emit, when supplied with an ionizing voltage from the power supply, ions outwardly from the airflow receiving face surface of said trapping medium into the oncoming air stream whereby an expanded zone of ionized air will be formed within the air stream in advance of the trapping medium and ion source thereby charging particles contained therein for deposit within the trapping medium when particles are carried into the trapping medium by the air stream.

2. An electronic air filtration assembly as in claim 1 characterized in that the ion source is in the form of an ion emitting point of a pointed, electrical conductor.

3. An electronic air filtration assembly as in claim 2 characterized by said ion emitting point being directed away from the face surface of the air filter trapping medium.

4. An electronic air filtration assembly as in claim 3 characterized in that the ion source is carried by an insulating base member, said base member being carried by said assembly and located intermediate to the ion source and the trapping medium.

5. An electronic air filtration assembly as in claim 4 characterized in that the base member extends laterally with respect to the ion source.

6. An electronic air filtration assembly as in claim 4 characterized by said ion source and base member being carried by a counter-electrode screen located adjacent the outer surface of said trapping medium.

7. An air filtration assembly as in claim 1 in combination with an air duct with the air filtration assembly mounted therein for passage of air flow therethrough, said duct being provided with a slot having a width to receive said air filtration assembly characterized by the ion source being mounted on said assembly and the combined thickness of the assembly, including the trapping medium and ion source, being less than the width of the slot to allow for the insertion of the combined assembly into said slot.

8. An air filtration assembly as in claim 4 characterized by a resilient support portion connected between the ion source and the base member whereby the pointed electrical conductor may be resiliently bent over from an upright position to reduce its height above the base member and enable a filter upon which the base member is attached to pass through a slot in an air handling system.

9. An air filtration assembly as in claim 8 characterized in that the pointed electrical conductor is a flexible fiber.

10. An air filtration assembly as in claim 8 characterized by the pointed electrical conductor being a needle and there being an indentation formed in the outer surface of the base member to receive the needle when the needle is bent over from an upright to a sideways orientation over the base member.

11. An air filtration assembly as in claim 4 characterized by the base member being dome-shaped with a recess formed in its outer face, and said ion source being positionable within the recess.

12. An air filtration assembly as in claim 4 characterized by the combination of said assembly with a field-gradient-inducing counter electrode in the form of metallic conductor positioned at or below the base member to provide, when charged, a potential gradient around the ion source that will produce ionization.

13. An air filtration assembly as in claim 12 characterized in that the counter-electrode comprises a conducting screen positioned adjacent to the air-receiving face of the trapping medium.

14. An air filtration assembly as in claim 12 characterized in that the counter-electrode is carried by and positioned adjacent to the periphery of the base member.

15. An air filtration assembly as in claim 12 characterized in that the counter-electrode comprises a conducting screen positioned adjacent to a face of the trapping medium on the side of said trapping medium opposite said ion source.

16. An air filtration assembly as in claim 1 characterized by the combination of the assembly with a high voltage power supply connected to said electrical coupling means to create a local field gradient around said ion source of sufficient intensity to cause said ion source to emit ions, but without creating a significant amount of ozone.

17. An air filtration assembly as in claim 16 characterized in that said voltage power supply provides a voltage potential to the ion source of between 5,000 and 15,000 volts.

18. An electronic air filtration assembly as in claim 16 characterized in that a power supply is mounted on the frame.

19. An air filtration assembly as in claim 16 characterized in that the trapping medium is a fibrous, polarizable substance which is electrically polarized by an applied electrical potential field provided by said power supply which is attached to the air filtration assembly.

20. An air filtration assembly as in claim 1 characterized in that the ion source comprises a conductive fibrous string extending along the face surface of the trapping medium said string being provided with multiple, protruding fiber ends distributed along its length to serve as multiple, ion sources.

21. An ion source for installation on an electronic air filtration assembly comprising:

(1) an ion emitting point of a pointed, electrical conductor;

(2) an insulating base member for supporting the ion emitting point, the insulating base member carrying a resilient support for the pointed electrical conductor, said ion emitting point being directed away from said base; and (3) electrical coupling means for connection of the ion pointed electrical conductor to a power supply that delivers an ionizing voltage;

whereby the pointed conductor may be resiliently bent over from an upright position to reduce its height above the base member.

22. An ion source as in claim 21 characterized in that the base member extends laterally with respect to the ion emitting point.

23. An ion source as in claim 22 comprising a field-gradient-inducing electrode carried by said base and electrical coupling means for connection of the electrode to a power source.

24. An ion source as in claim 21 wherein the pointed electrical conductor is a flexible fiber.

25. An ion source as in claim 21 characterized by the pointed electrical conductor being a needle.

26. An ion source as in claim 22 characterized by the pointed electrical conductor being a needle.

27. An ion source as in claim 26, there being an indentation formed in the upper surface of the base member to receive the needle when the needle is bent over from an upright to a sideways orientation over the base member.

* * * * *